US006467878B1

(12) United States Patent
Steinfield et al.

(10) Patent No.: US 6,467,878 B1
(45) Date of Patent: Oct. 22, 2002

(54) SYSTEM AND METHOD FOR LOCALLY CONTROLLING THE THICKNESS OF A FLEXIBLE NOZZLE MEMBER

(75) Inventors: Steven W. Steinfield, San Diego, CA (US); Craig Andrew LeVier, Escondido, CA (US); John Dangelewicz, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/569,585

(22) Filed: May 10, 2000

(51) Int. Cl.[7] ..... B41J 2/14
(52) U.S. Cl. ..... 347/47
(58) Field of Search ..... 347/63, 47, 56, 347/86, 87, 65

(56) References Cited

U.S. PATENT DOCUMENTS

| | | | | |
|---|---|---|---|---|
| 4,683,481 A | * | 7/1987 | Johnson | 347/65 |
| 5,066,357 A | | 11/1991 | Smyth, Jr. et al. | 216/18 |
| 5,278,584 A | | 1/1994 | Keefe et al. | 347/63 |
| 5,291,226 A | * | 3/1994 | Schantz et al. | 347/63 |
| 5,305,018 A | | 4/1994 | Schantz et al. | 347/47 |
| 5,312,517 A | | 5/1994 | Ouki | 216/27 |
| 5,350,616 A | | 9/1994 | Pan et al. | 428/131 |
| 5,378,137 A | | 1/1995 | Asakawa et al. | 425/174.4 |
| 5,453,769 A | | 9/1995 | Schantz et al. | 347/63 |
| 5,467,115 A | | 11/1995 | Childers | 347/47 |
| 5,847,725 A | | 12/1998 | Cleland et al. | 347/20 |
| 5,852,460 A | | 12/1998 | Schaeffer et al. | 347/87 |

FOREIGN PATENT DOCUMENTS

| | | | | |
|---|---|---|---|---|
| EP | 0867292 A2 | | 9/1998 | B41J/2/14 |
| EP | 0997284 A2 | | 5/2000 | B41J/2/14 |
| GB | 2327064 A | * | 1/1999 | B41J/2/14 |
| JP | 02076744 | | 3/1990 | B41J/2/05 |
| JP | 11-074431 | * | 3/1999 | H01L/23/40 |

* cited by examiner

*Primary Examiner*—John Barlow
*Assistant Examiner*—Blaise Mouttet

(57) ABSTRACT

The present invention is embodied in a system and method for locally controlling the thickness of a flexible nozzle member of a printhead portion of an inkjet printer. The printing system of the present invention includes a printhead assembly and an ink supply for printing ink on print media. The printhead assembly includes a printhead body, ink channels, a semiconductor wafer, a nozzle member and a barrier layer located between the wafer and nozzle member. The nozzle member has plural nozzles coupled to respective ink channels and is secured at a predefined location to the printhead body with a suitable adhesive layer. The flexible member has a mechanical feature defining local thickness variations of the flexible nozzle member. The mechanical feature can be defined in the flexible nozzle member as extending in a range in close proximity to the ink channel and the adhesive. The mechanical feature reduces the stiffness of the flexible nozzle member near the ink channel or near the adhesive for reducing the stress transmitted to an outside portion of the barrier layer. Thus, the present invention reduces trajectory errors of ejected ink droplets from the nozzles.

20 Claims, 3 Drawing Sheets

SYSTEM AND METHOD FOR LOCALLY CONTROLLING THE THICKNESS OF A FLEXIBLE NOZZLE MEMBER

FIELD OF THE INVENTION

The present invention generally relates to inkjet and other types of printers and more particularly, to a system and method for locally controlling the thickness of a flexible nozzle member of a printhead portion of an inkjet printer.

BACKGROUND OF THE INVENTION lnkjet printers are commonplace in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Inkjet printers produce high quality print, are compact and portable, and print quickly and quietly because only ink strikes a printing medium, such as paper.

An inkjet printer produces a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet printers print dots by ejecting very small drops of ink onto the print medium and typically include a movable carriage that supports one or more print cartridges each having a printhead with a nozzle member having ink ejecting nozzles. The carriage traverses over the surface of the print medium. An ink supply, such as an ink reservoir, supplies ink to the nozzles. The nozzles are controlled to eject drops of ink at appropriate times pursuant to command of a microcomputer or other controller. The timing of the application of the ink drops is intended to correspond to the pattern of pixels of the image being printed.

In general, the small drops of ink are ejected from the nozzles through orifices by rapidly heating a small volume of ink located in vaporization chambers with small electric heaters, such as small thin film resistors. The small thin film resistors are usually located adjacent the vaporization chambers. Heating the ink causes the ink to vaporize and be ejected from the orifices. Specifically, for one dot of ink, an electrical current from an external power supply is passed through a selected thin film resistor of a selected vaporization chamber. The resistor is then heated for superheating a thin layer of ink located within the selected vaporization chamber, causing explosive vaporization, and, consequently, a droplet of ink is ejected from the nozzle and onto a print media. One very important factor in assuring high print quality is the accuracy of the trajectory of the ejected droplet since this affects where it lands upon the print media. The accuracy of this trajectory is mostly dependent upon the particular geometry of the nozzle.

One challenge in controlling the nozzle geometry and hence trajectory of the droplets is to regulate bending and/or buckling of the nozzle member, otherwise known as "dimpling" of the nozzle member. Dimpling of the nozzle member causes the nozzles to be skewed, which leads to imprecise nozzle geometry. Dimpling tends to be induced during print cartridge manufacturing, which includes cartridge assembly processes such as adhesively bonding the printhead to the cartridge. More specifically, dimpling can be caused by inadvertent bending and/or buckling of the nozzle member due to structural thermal expansions and contractions occurring when the nozzle member is adhesively sealed to the print cartridge. For example, during the heat, cure and cool process when the nozzle member is adhered to the cartridge, the cartridge experiences thermal expansions and contractions. These thermal expansions and contractions cause the nozzle member to buckle, bend and deform, thereby skewing the nozzles.

Since dimpling of the nozzle member skews the nozzles, it tends to adversely affect nozzle geometry, thereby causing nozzle trajectory errors. A measure of this bending of the nozzle member is referred to as the "nozzle camber angle" (NCA), which is proportional to the bending of the nozzle member from an ideal flat state. Poor nozzle camber angle (NCA) causes ink drop trajectory errors and uncontrolled ink drop directionality. In other words, when the printhead assembly is scanned across a recording medium, the NCA-induced ink drop trajectory errors will affect the location of printed dots and, thus, affect the quality of printing. Also, the bending of the nozzle member can restrict ink flow into nozzles, thus limiting the refill speed and hence the maximum droplet ejection frequency. This in turn limits printer speed. Therefore, what is needed is a nozzle member that has incurred limited bending or deformation during manufacturing of the print cartridge and to be as flat as possible. What is also needed is a printing system incorporating a device that reduces dimpling of a nozzle member during manufacture of a printhead portion of an inkjet printer.

SUMMARY OF THE INVENTION

To overcome the limitations in the prior art described above, and to overcome other limitations that will become apparent upon reading and understanding the present specification, the present invention is embodied in a system and method for locally controlling the thickness of a flexible nozzle member of a printhead portion of an inkjet printer.

The printing system of the present invention includes a printhead assembly and an ink supply for printing ink on print media. The printhead assembly includes a printhead body, ink channels, a substrate, such as a semiconductor wafer, a nozzle member and a barrier layer located between the wafer and nozzle member. The nozzle member has plural nozzles coupled to respective ink channels and is secured at a predefined location to the printhead body with a suitable adhesive layer. The flexible member has a mechanical feature defining local thickness variations of the flexible nozzle member. The mechanical feature can be defined in the flexible nozzle member as extending in a range in close proximity to the ink channel and the adhesive. The mechanical feature can be created by any suitable process, such as with a special mask or a thinning mask during laser ablation, with wafer saws or with a suitable etching technique.

The mechanical feature reduces the stiffness of the flexible nozzle member near the ink channel or near the adhesive for reducing the stress transmitted to an outside portion of the barrier layer. Consequently, the present invention aids in controlling the nozzle camber angle (NCA), which is proportional to the bending of the nozzle member from an ideal flat state. Since poor NCA causes ink drop trajectory errors and uncontrolled ink drop directionality, control of the NCA by the present invention will result in reduced trajectory errors of ejected ink droplets from the nozzles.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

General Overview

Figure 1:
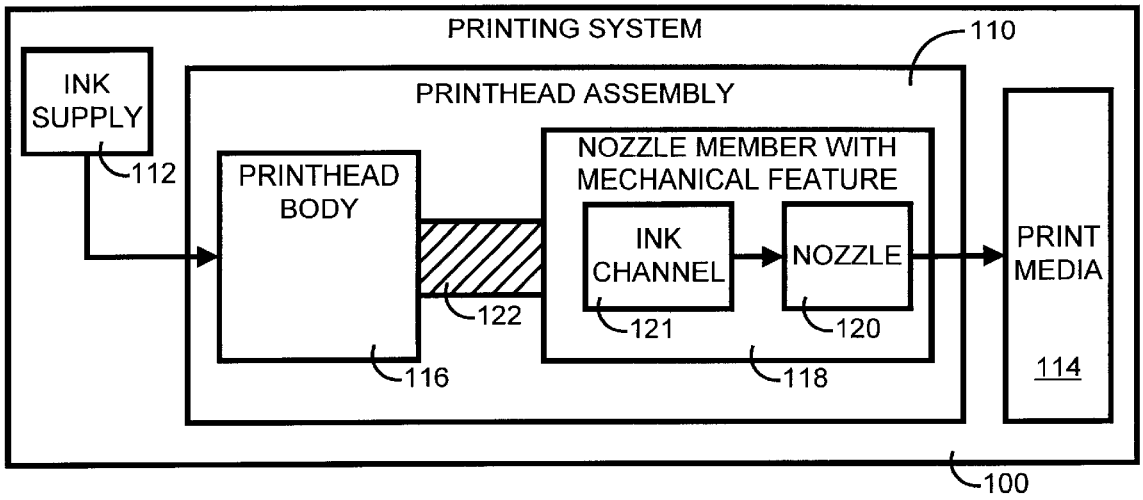
FIG. 1 shows a block diagram of an overall printing system incorporating the present invention.

FIG. 1 shows a block diagram of an overall printing system incorporating the present invention. The printing system 100 of the present invention includes a printhead assembly 110, an ink supply 112 and print media 114. The printhead assembly 110 includes a printhead body 116, a flexible nozzle member 118 with orifices or nozzles 120 fluidically coupled to associated ink channels 121. The printhead body 116 is securely coupled to the nozzle member 118 with an adhesive arrangement 122.

During a printing operation, ink is provided from the ink supply 112 to an interior portion (such as an ink reservoir) of the printhead body 116. The interior portion of the printhead body 116 provides ink to the ink channels 121 for allowing ejection of ink through adjacent nozzles 120. Namely, the printhead assembly 110 receives commands from a processor (not shown) to print ink and form a desired pattern for generating text and images on the print media 114. Print quality of the desired pattern is dependent on accurate placement of the ink droplets on the print media 114.

One way to increase print quality is to improve the accuracy and precision of ink droplet placement. This can be achieved by limiting the skew of the nozzles by minimizing nozzle camber angle (NCA). To achieve this, in one embodiment of the present invention the nozzle member includes a mechanical feature to define local thickness variations of the flexible nozzle member. The mechanical feature reduces the stiffness of the flexible nozzle member 118 near the ink channel 121 or near the adhesive 122 for reducing the stress transmitted to certain portions of the printhead assembly.

The mechanical feature can be any physical feature or geometrical arrangement that imparts local thickness variations in the flexible nozzle member. Localized control of the thickness of the flexible nozzle member 118 helps control the nozzle camber angle (NCA) for creating a flatter flexible nozzle member 118 during the adhesion process, which typically includes heating and curing the adhesive. Consequently, skewing of the nozzles is reduced and NCA is improved, and thus, trajectory errors for the ejected ink droplets from the nozzles 120 are reduced.

Exemplary Printing System

Figure 2:
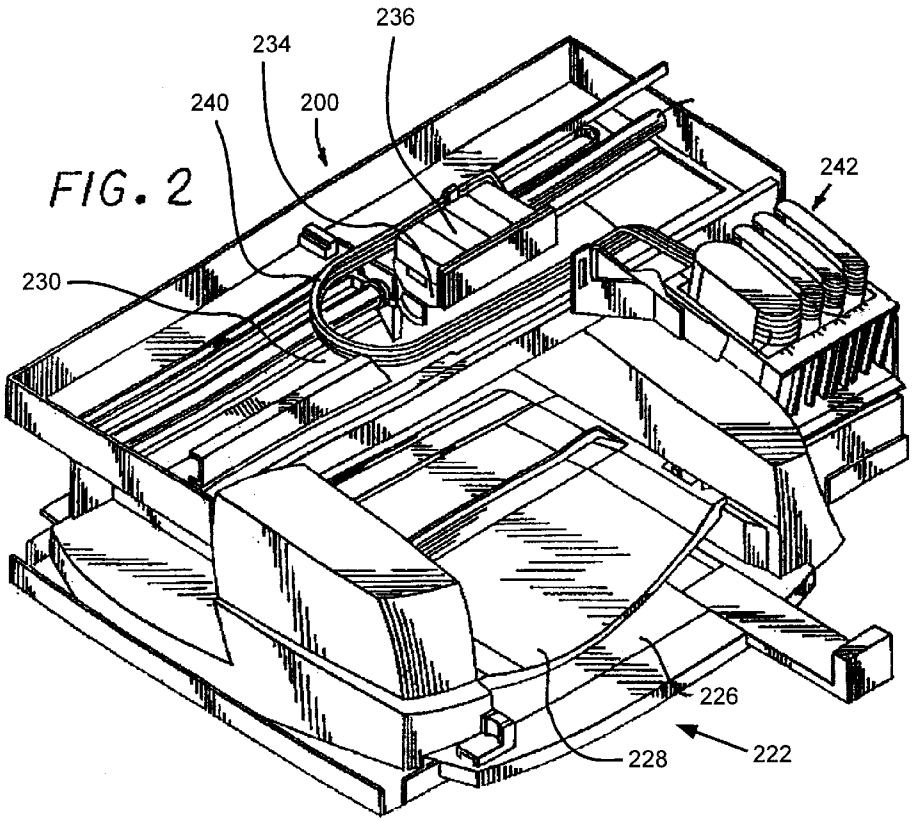
FIG. 2 is an exemplary printer that incorporates the invention and is shown for illustrative purposes only.

FIG. 2 is an exemplary high-speed printer that incorporates the invention and is shown for illustrative purposes only. Generally, printer 200 includes a tray 222 for holding print media 114 (shown in FIG. 1). When a printing operation is initiated, print media 114, such as a sheet of paper, is fed into printer 200 from tray 222 preferably using a sheet feeder 226. The sheet then brought around in a U direction and travels in an opposite direction toward output tray 228. Other paper paths, such as a straight paper path, can also be used. The sheet is stopped in a print zone 230, and a scanning carriage 234, supporting one or more print cartridges 236, is then scanned across the sheet for printing a swath of ink thereon. After a single scan or multiple scans, the sheet is then incrementally shifted using, for example, a stepper motor and feed rollers to a next position within the print zone 230. Carriage 234 again scans across the sheet for printing a next swath of ink. The process repeats until the entire sheet has been printed, at which point it is ejected into output tray 228.

The present invention is equally applicable to alternative printing systems (not shown) such as those incorporating grit wheel or drum technology to support and move the print media 114 relative to the printhead assembly 110. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 may be removeably mounted or permanently mounted to the scanning carriage 234. Also, the print cartridges 236 can have self-contained ink reservoirs in the body of the printhead (shown in FIG. 3) as the ink supply 112 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 112 (shown in FIG. 1). As a further alternative, ink supplies 112 can be one or more ink containers separate or separable from print cartridges 236 and removeably mountable to carriage 234.

Figure 3:
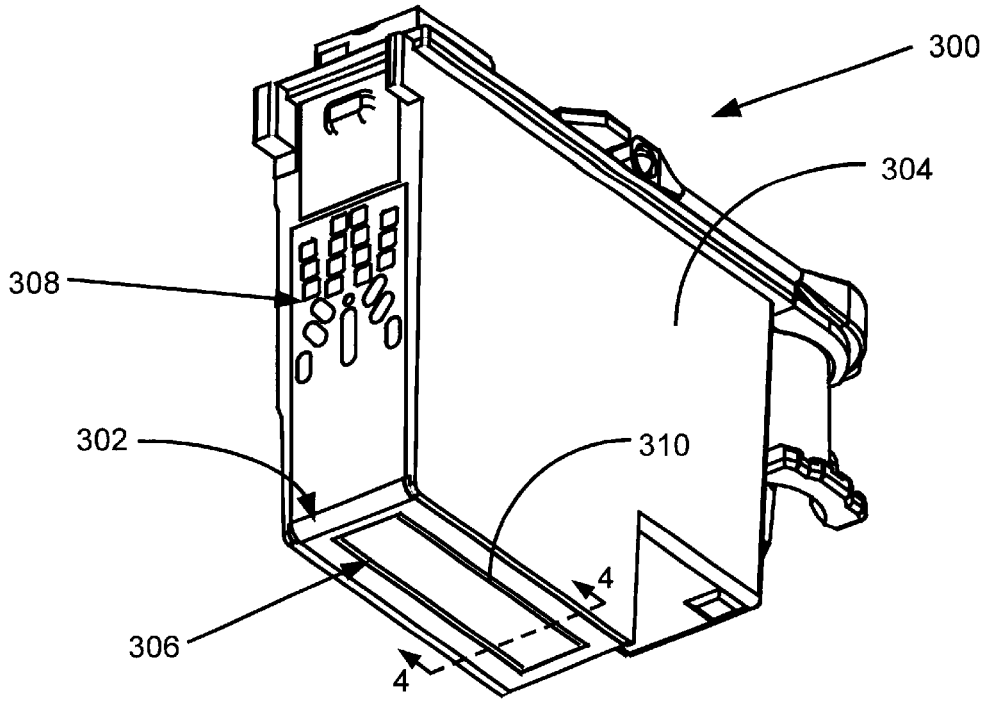
FIG. 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 110 of FIG. 1) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal head assembly 302 and a printhead body 304. The thermal head assembly 302 can be a flexible material commonly referred to as a Tape Automated Bonding (TAB) assembly. The thermal head assembly 302 contains a flexible nozzle member 306 and interconnect contact pads 308 and is secured to the printhead assembly 300. The thermal head assembly 302 can be secured to the print cartridge 300 with suitable adhesives. An integrated circuit chip (not shown) provides feedback to the printer 200 regarding certain parameters of printhead assembly 300. The contact pads align with and electrically contact electrodes (not shown) on carriage 234. The nozzle member 306 preferably contains plural parallel rows of offset nozzles 310 through the thermal head assembly 306 created by, for example, laser ablation. It should be noted that other nozzle arrangements can be used, such as non-offset parallel rows of nozzles. example, laser ablation. It should be noted that other nozzle arrangements can be used, such as non-offset parallel rows of nozzles.

Component Details

Figure 4:
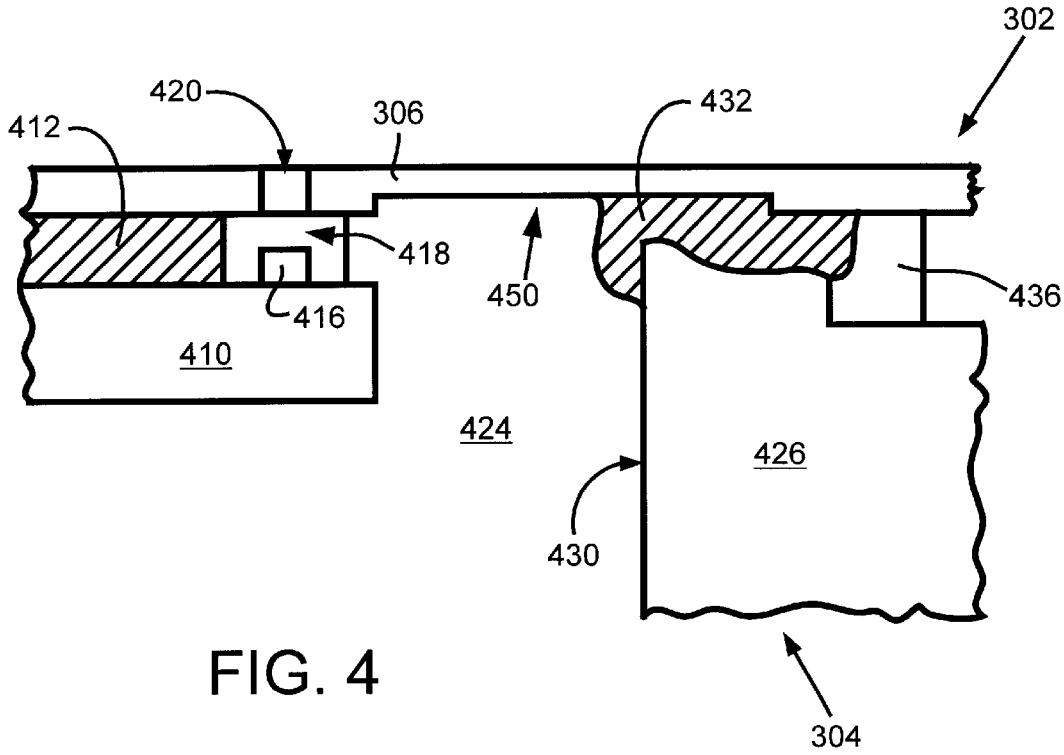
FIG. 4 is a schematic cross-sectional view taken through section line 4—4 of FIG. 3 showing the adhesive arrangement of the print cartridge of FIGS. 1 and 3.

FIG. 4 is a cross-sectional schematic taken through section line 4—4 of FIG. 3 of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of thermal head assembly 302 and terminate in contact pads for contacting electrodes on carriage 234. The other ends of the conductors are bonded to the printhead 302 via terminals or electrodes (not shown) of a substrate 410. The substrate 410 has ink ejection elements 416 formed thereon and electrically coupled to the conductors. The integrated circuit chip provides the ink ejection elements 416 with operational electrical signals. A barrier layer 412 is located between the nozzle member 306 and the substrate 410 for insulating conductive elements from the substrate 410.

An ink ejection or vaporization chamber 418 is adjacent each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzles 420 can be located in other areas of the nozzle member 306, such as centered between an edge of the substrate 410 and an interior side of the body 304. Each ink ejection element 416 acts as ohmic heater when selectively energized by one or more pulses applied sequentially or simultaneously to one or more of the contact pads via the integrated circuit. The ink ejection elements 416 may be heater resistors or piezoelectric elements. The orifices 420 may be of any size, number, and pattern, and the various figures are designed to simply and clearly show the features of the invention. The relative dimensions of the various features have been greatly adjusted for the sake of clarity.

The printhead body 304 is defined by a headland portion 426 located proximate to the back surface of the nozzle member 306 and includes an inner raised support 430. An adhesive layer 432 is located between the back surface of the nozzle member 306 and a top surface of the inner raised support 430 to securely affix the nozzle member 306 to the headland 426. The inner raised support 430 preferably includes an overflow slot 436 for receiving excess adhesive (i.e., adhesive overflow during fabrication of the printhead). The adhesive layer 432 forms an adhesive seal between the nozzle member 306 of the thermal head assembly 302 and the headland 426. Some adhesives that can be used include hot-melt, silicone, UV curable adhesive, and mixtures thereof. Further, a patterned adhesive film may be positioned on the headland 426, as well as a dispensed bead of adhesive.

Referring to FIGS. 1–4, during a printing operation, ink stored in an ink reservoir 424 defined by the printhead body 304 generally flows around the edges of the substrate 410 and into the vaporization chambers 418. Energization signals are sent to the ink ejection elements 416 and are produced from the electrical connection between the print cartridges 236 and the printer 200. Upon energization of the ink ejection elements 416, a thin layer of adjacent ink is superheated to provide explosive vaporization and, consequently, cause a droplet of ink to be ejected through the orifice or nozzle 420. The vaporization chamber 418 is then refilled by capillary action. This process enables selective deposition of ink on print media 114 to thereby generate text and images.

During typical fabrication of the printhead assembly 300 and adhesion of the nozzle member 306 to the headland 426, dimpling is usually formed in the nozzle member 306 and thermal head assembly 302. Dimpling is caused by inadvertent bending or deformation of the flexible nozzle member 306 and thermal head assembly 302. Bending and deformation can be caused by disproportionate thermal expansion and contraction of the headland 426 as compared to the thermal expansion and contraction of the flexible nozzle member 306. In other words, since the flexible nozzle member 306 and the headland 426 are typically made of different materials, their respective coefficients of thermal expansion and contraction are different so they deform disproportionately.

Thermal expansion, bending or deformation of the flexible nozzle member 306 occurs when a dispersed (non-localized) heat source, such as hot air, is applied to the flexible nozzle member 306 to initiate curing of the adhesive 432. Thermal contraction, bending or deformation of the flexible nozzle member 306 occurs when cooling is applied to the flexible nozzle member 306 to finalize curing of the adhesive and to seal the flexible nozzle member 306 to the headland 426. This bending or deformation causes dimpling of the nozzle member 306, which results in skewed nozzles 420, thereby causing trajectory errors for the ejected ink droplets from the nozzles 420. Consequently, when the printhead assembly 300 is scanned across the print media during printing, the ink trajectory errors will affect the location of the ejected ink and reduce the quality of printing.

To improve the NCA, the present invention is embodied in a system and method for locally controlling the thickness of the flexible nozzle member 306. A mechanical feature 450 defined in the flexible member 306 can be used to define local thickness variations of the flexible nozzle member 306. The mechanical feature can be defined as a recess or an area 450 in the flexible nozzle member 306 that is thinner than other portions of the flexible nozzle member 306. The mechanical feature 450 can extend as a thinned portion of the flexible nozzle member 306 in a range in close proximity to the ink channel 418 and the adhesive layer 432. The mechanical feature 450 can be any physical feature or geometrical arrangement that imparts a thickness variation to the nozzle member 306. The mechanical feature 450 can be created in the nozzle member 306 by any suitable process, such as with a special mask or a thinning mask during laser ablation, with wafer saws or with a suitable etching technique (for example chemical or ion beam etching).

Figure 5A:
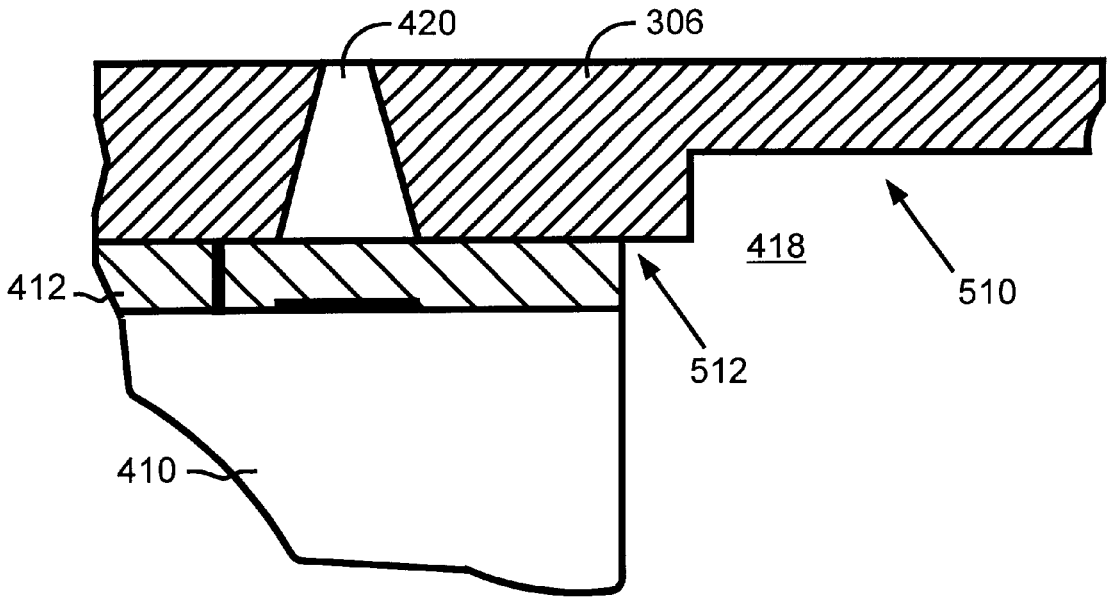
FIGS. 5A and 5B are schematic cross-sectional views taken through section line 4—4 of FIG. 3 showing other arrangements of the print cartridge of FIGS. 1 and 3.
Figure 5B:
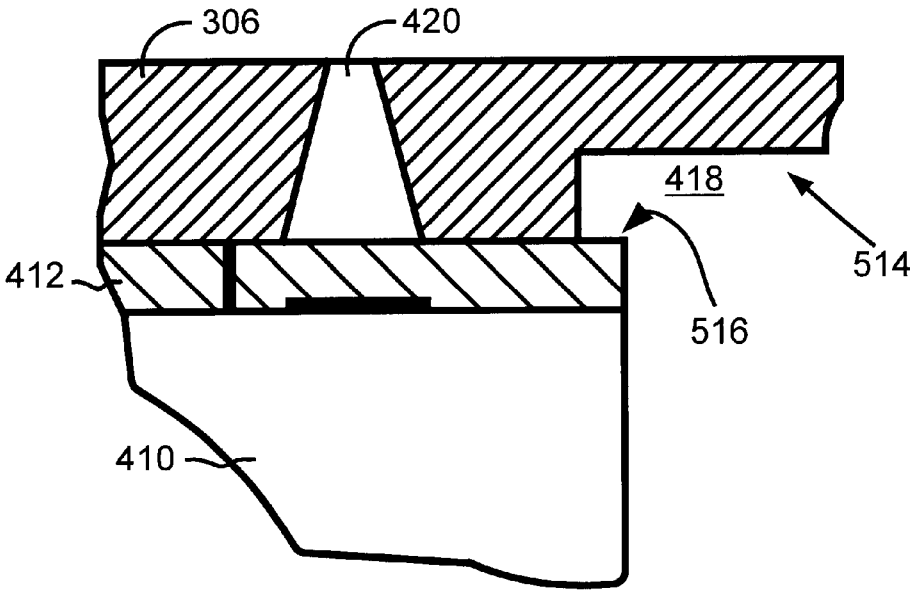

FIGS. 5A and 5B are schematic cross-sectional views taken through section line 4—4 of FIG. 3 showing other arrangements of the print cartridge of FIGS. 1 and 3. Referring to FIG. 4 along with FIGS. 5A and 5B, in the embodiment of FIG. 5A, the mechanical feature 450 of FIG. 4 can be defined as mechanical feature 510. The mechanical feature 510 extends from over a portion of the adhesive layer 432 to after an eave 512 defined by the wafer 410, the barrier layer 412 and the flexible nozzle member 306, as shown in FIG. 5A. This configuration reduces the stiffness further out toward the ink channel 418 while reducing the sensitivity of the drop volume and refill on NCA by raising an eave height, as shown in FIG. 5A.

In the embodiment of FIG. 5B, the mechanical feature 450 can be defined as mechanical feature 514 and can extend from over a portion of the adhesive layer 432 to before an edge 516 defined by the wafer 410 and the barrier layer 412, as shown in FIG. 5B. This configuration maintains full stiffness in an area close to the edge 516, but reduces the stiffness further out toward the ink channel 418.

Therefore, in conclusion, the mechanical feature 450 reduces the stiffness of the flexible nozzle member 306 near the ink channel 418 or near the adhesive 432 for reducing the stress transmitted to an outside portion of the barrier layer. Localized control of the thickness of the flexible nozzle member 118 helps control the nozzle camber angle (NCA) for creating a flatter flexible nozzle member 118 during the adhesion process, which typically includes heating and curing the adhesive. Consequently, skewing of the nozzles is reduced and NCA is improved, and thus, trajectory errors for the ejected ink droplets from the nozzles 120 are reduced.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A printing system comprising:

an inkjet printhead having a body, a substrate, a barrier layer and ink ejection devices; and a flexible nozzle member attached to the body by an adhesive layer and including a mechanical feature defining a first portion with a first thickness in close proximity to the ink ejection devices and a second portion with a second thickness different than the first thickness;

wherein the mechanical feature extends from over a portion of the adhesive layer to after an eave defined by the substrate, the barrier layer and the flexible nozzle member for reducing stiffness of the flexible nozzle member near an ink channel while maintaining its stiffness in an area close to the eave.

2. The printing system of claim 1, wherein the mechanical feature is a recess that is thinner than other portions of the nozzle member.

3. The printing system of claim 2, wherein the recess is defined by a thinned portion suitable to reduce trajectory errors of ejected ink droplets from the nozzle member.

4. The printing system of claim 2, wherein the mechanical feature is created by a thinning mask during laser ablation.

5. The printing system of claim 2, wherein the mechanical feature is created by a wafer saw.

6. The printing system of claim 2, wherein the mechanical feature is created by a suitable material removal process.

7. The printing system of claim 2, wherein the substrate has a front surface and an opposing back surface and ink ejection elements being formed on the front surface.

8. The printing system of claim 1, further comprising an ink supply for providing ink to the printhead.

9. The printing system of claim 8, wherein the ink supply is a removeably mounted ink container.

10. The printing system of claim 1, further comprising a carriage supporting the printhead over a print media.

11. A nozzle member coupled to a printhead body by an adhesive layer and located above an ink channel for an inkjet printhead comprising:

a substrate;

a flexible member having a mechanical feature defining a first portion with a first thickness in close proximity to the ink channel and a second portion with a second thickness different than the first thickness; and a barrier layer mounted between the flexible member and the substrate, wherein the mechanical feature extends from over a portion of the adhesive layer to after an eave defined by the substrate, the barrier and the flexible member for reducing stiffness of the nozzle member near the ink channel while maintaining it's stiffness in an area close to the eave.

12. The nozzle member of claim 11, further comprising an adhesive layer connecting the flexible member to the barrier layer.

13. The nozzle member of claim 11, wherein the mechanical feature is defined to maintain stiffness in an area close to an edge while reducing stiffness near the ink channel.

14. The nozzle member of claim 11, wherein the mechanical feature is a recess that is thinner than other portions of the flexible member.

15. The nozzle member of claim 14, wherein the recess is defined by a thinned portion suitable to reduce trajectory errors of ejected ink droplets from the nozzle member.

16. A printing method comprising:

attaching a nozzle member above an ink channel and to a substrate on a first end and a printhead body on a second end for facilitating disposal of ink drops from the ink channel;

maintaining stiffness of the nozzle member in an area close to an edge defined by the first end while reducing stiffness near the ink channel;

extending a mechanical feature from over a portion of an adhesive layer located above the ink channel near the printhead body to after an eave defined by the substrate and the nozzle member;

providing ink from an ink supply to the ink channel to enable the printhead to print the ink.

17. The method of claim 16, further comprising refilling the ink supply.

18. The method of claim 16, wherein extending a mechanical feature further comprises reducing stiffness toward the ink channel while reducing sensitivity of ink drop volume and refill by raising an eave height.

19. The method of claim 18, wherein the mechanical feature is a recess that is thinner than other portions of the flexible member.

20. The method of claim 19, wherein the recess is defined by a thinned portion suitable to reduce trajectory errors of ejected ink droplets from the nozzle member.

* * * * *